US005282009A

United States Patent [19]

Derimiggio

[11] Patent Number: 5,282,009

[45] Date of Patent: Jan. 25, 1994

[54] REPRODUCTION APPARATUS HAVING A PROCESS CONTROL SKIVE DEVICE

[75] Inventor: John E. Derimiggio, Fairport, N.Y.

[73] Assignee: Eastman Kodak Company, Rochester, N.Y.

[21] Appl. No.: 983,066

[22] Filed: Nov. 27, 1992

[51] Int. Cl.[5] ..... G03G 15/20

[52] U.S. Cl. ..... 355/315; 73/862.44; 271/900; 355/284; 355/285

[58] Field of Search ..... 355/315, 282, 285, 290, 355/295, 284; 271/900; 73/862.44, 862.451, 862.471, 862.472, 862.473, 862.474, 862.55

[56] References Cited

U.S. PATENT DOCUMENTS

| | | | |
|---|---|---|---|
| 4,232,959 | 11/1980 | Ateya et al. | 355/290 |
| 4,269,594 | 5/1981 | Umans et al. | 432/59 |
| 4,496,234 | 1/1985 | Schram | 355/284 |
| 4,684,784 | 8/1987 | Tamary | 219/216 |
| 4,806,985 | 2/1989 | Foley et al. | 271/900 X |
| 4,952,982 | 8/1990 | Tabuchi | 355/315 X |

*Primary Examiner*—A. T. Grimley
*Assistant Examiner*—Nestor R. Ramirez
*Attorney, Agent, or Firm*—Tallam I. Nguti

[57] ABSTRACT

A reproduction apparatus having a series of process stations and a logic and control unit for controlling the operations of the process stations includes a fuser and pressure roller-type fusing apparatus. The fusing apparatus includes a member for oiling the fuser roller, and a fuser skive device with finger portions that contactably ride on the fuser roller for stripping copy sheets. The finger portions are mounted to a flexible member that is connected to strain gauges which sense actual sheet stripping forces on the finger portions. The strain gauges are connected to the logic and control unit which contains a preprogrammed stand for sheet stripping forces on the finger portions on ideal process station conditions. The logic and control unit compares the sensed actual sheet stripping forces from the finger portions for any deviations from such stand, and then use such deviation to adjust an operating condition of at least a process station.

19 Claims, 3 Drawing Sheets

REPRODUCTION APPARATUS HAVING A PROCESS CONTROL SKIVE DEVICE

BACKGROUND OF THE INVENTION

1. Technical Field

The present invention relates to electrostatographic reproduction apparatus such as copiers and printers which produce fused toner images on copy sheets. More particularly, the present invention relates to such a reproduction apparatus which includes a process control skive device that strips copy from the fusing mechanism of the reproduction apparatus.

2. Background Art

Electrostatographic reproduction apparatus such as copiers and printers, which produce or reproduce toner images on copy sheets by employing electrostatic charges and toner particles on an image-bearing surface, are well known. Typically, such copiers and printers operate through a sequence of currently well known electrostatographic process steps These process steps for example include (1) charging an insulated photoconductive surface with electrostatic charges, (2) forming a latent image electrostatically on such surface by selectively discharging areas on such surface, (3) developing the electrostatic image so formed with particles of toner to form a toned image, (4) transferring the toned image to a suitable copy sheet, (5) fusing the transferred toned image onto the copy sheet by moving the copy sheet through a fusing apparatus, and (6) cleaning the photoconductive surface after image transfer by removing residual toner and/or other particles therefrom in preparation for similarly reusing such surface to produce another such image.

As disclosed for example in U.S. Pat. No. 4,232,959, issued Nov. 11, 1980 to Ateya et al; U.S. Pat. No. 4,269,594, issued May 26, 1981 to Umans et al; U.S. Pat. No. 4,496,234, issued Jan. 29, 1985 to Schram; and U.S. Pat. No. 4,684,784, issued Aug. 4, 1987 to Tamary, a typical fusing apparatus for use in such copiers and printers includes a heated, rotatable fuser roller, and a rotatable pressure roller that forms a contact fusing nip with the fuser roller. The suitable copy sheet carrying the toned image is moved contactably through the contact fusing nip such that the toned image directly contacts the heated fuser roller.

As further disclosed, for example in the U.S. Pat. No. 4,684,784 patent, skive devices are well known for stripping the copy sheet from the heated fuser roller as the copy sheet exits from the contact fusing nip. The quality of the fused image produced on the copy sheet depends significantly on how well the toner particles, which form the toned image, are heated and fused, on how well and efficiently the toned image is released from the surface of the fuser roller, and on how clean and unsoiled non-image areas of the copy sheet are, as the copy sheet exits the contact fusing nip. It has been found that besides temperature and rotational speed of the fuser roller, the density or degree of toner particle laydown of an image being fused, also significantly affects how well the toner particles forming the toned image are heated and fused. How well and how efficiently the toned image is released from the fuser roller, and how clean and un-soiled the copy sheet is, depend in part on the adequacy of a rate of toner release oil that is applied to the surface of fuser roller.

SUMMARY OF THE INVENTION

It is an object of the present invention to provide in a reproduction apparatus a process control means for commonly controlling the degree of toner particle laydown and the rate of release oil application to a fuser roller responsively to fused copy conditions at the fuser roller.

In accordance with the present invention, a skive device is provided for stripping copy sheets from the surface of a fuser roller of a reproduction apparatus. The skive device includes a rigid support portion and a finger portion. The finger portion has a first end, and a second end that contactably rides on the surface of the fuser roller in order to experience an actual copy sheet stripping force when stripping a copy sheet from the fuser roller. The first end of the finger portion is connected to a first end of an elongate flexible member. The second end of the flexible member is connected to the rigid support portion, and the flexible member, as such, serves to receive and transmit actual copy sheet stripping forces experienced by the finger portion. The skive device also includes a force measurement device that is mounted on the flexible member for measuring actual copy sheet stripping forces being received from the finger portion by the flexible member, whereby the measured forces can be used to control processes of the reproduction apparatus.

BRIEF DESCRIPTION OF THE DRAWINGS

In the detailed description of the invention presented below, reference is made to the drawings, in which.

DETAILED DESCRIPTION OF THE INVENTION

Because electrostatographic reproduction apparatus are well known, the present description will be directed in particular to elements thereof which form part of or cooperate more directly with the present invention. Elements thereof not specifically shown or described herein are assumed selectable from those known in the prior art.

Figure 1:
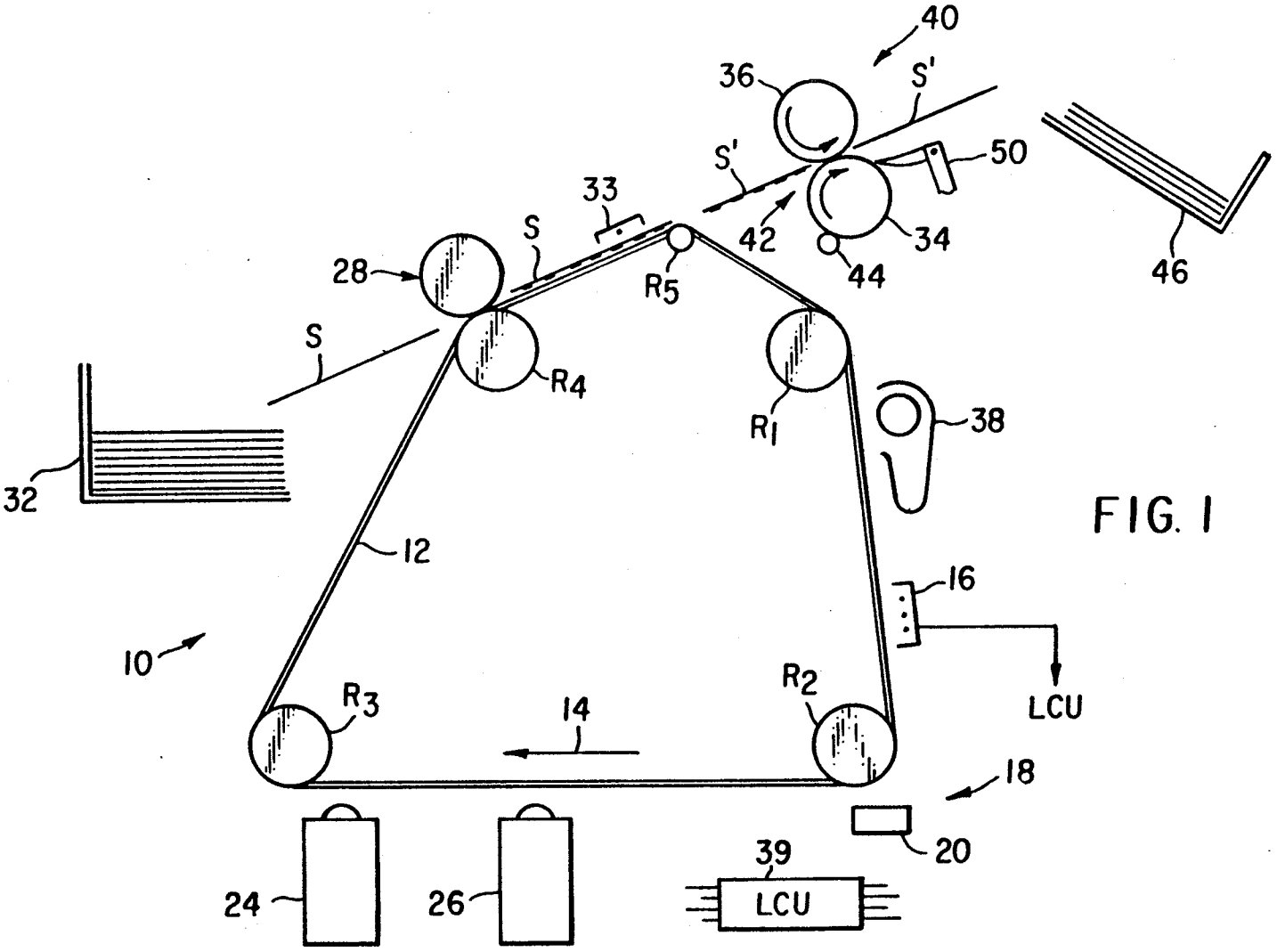
FIG. 1 is a schematic illustration of an exemplary reproduction apparatus incorporating the skive device of the present invention.

Referring to FIG. 1, an electrostatographic reproduction apparatus 10 such as a copier or printer has a movable dielectric image forming and image transfer member that can be a rigid rotatable drum, or as shown a flexible photo-conductive web 12. The flexible web 12 is trained over a series of rotatable rollers including the rollers $R_1$, $R_2$, $R_3$, $R_4$ and $R_5$, and is moved by suitable drive means (not shown) in a clockwise direction as represented by an arrow 14.

A charging station 16 includes charging means which applies a uniform layer of electrostatic charge to the surface of the photo-conductive web 12. The charge layer is applied such that it has a desired potential level. At an exposure station 18, projected light from a write head 20, for example, imagewise dissipates electrostatic charge on parts of the surface of the web 12 in order to form a latent electrostatic image corresponding to the image of an original to be copied or printed. Write head 20 preferably has an array of light-emitting diodes (LEDs) for exposing the photoconductive belt, but it is to be understood that other technologies for imagewise exposure, for example optical technologies, are equally applicable.

The latent electrostatic image on the surface of the web 12 is developed with a laydown of toner particles at a development station 24 forming a toner image. The toner particle laydown developing the latent image has a density that is proportional to the potential level of the layer of charge laid down at the charging station 16. As the toner image on web 12 approaches a transfer station 28, an image receiver or copy sheet S is fed from a supply 32 of such sheets for receiving such image. The copy sheet (now S' carrying the toner image) is stripped and separated from the web 12, after the transfer station 28. The separation of the copy sheet S' is achieved over a detack roller $R_5$ assisted by a detack charger 33 which reduces the level of charges tending to hold the sheet S' to the web 12.

Following such separation, the web 12 continues its clockwise movement over $R_1$ towards the charging station 16. As shown, the web 12 is then cleaned at a cleaning station 38 where residual toner particles are removed in order to prepare the web for the formation and transfer of another toner image. Meanwhile, the copy sheet S' following separation from the web 12 is moved to the fusing apparatus 40 of the present invention.

As shown, the fusing apparatus 40 includes a pair of fusing rollers 34, 36 which form a fusing nip 42. An oiling member 44 applies toner release oil to the surface of one of the rollers, the fuser (heated) roller 34 which directly contacts the toned or toner image on the copy sheet S' as it is moved through the nip 42. As the copy sheet now S" exits the fusing nip 42, it is stripped from the surface of the fuser roller 34 by the skive device of the present invention, shown generally as 50. The fused copy sheet S" is collected, for example, in an output tray 46.

As is well known in the art, the operation and sequencing of the various process stations and components of the reproduction apparatus 10 are controlled by a logic and control unit (LCU) shown as 39.

Figure 2:
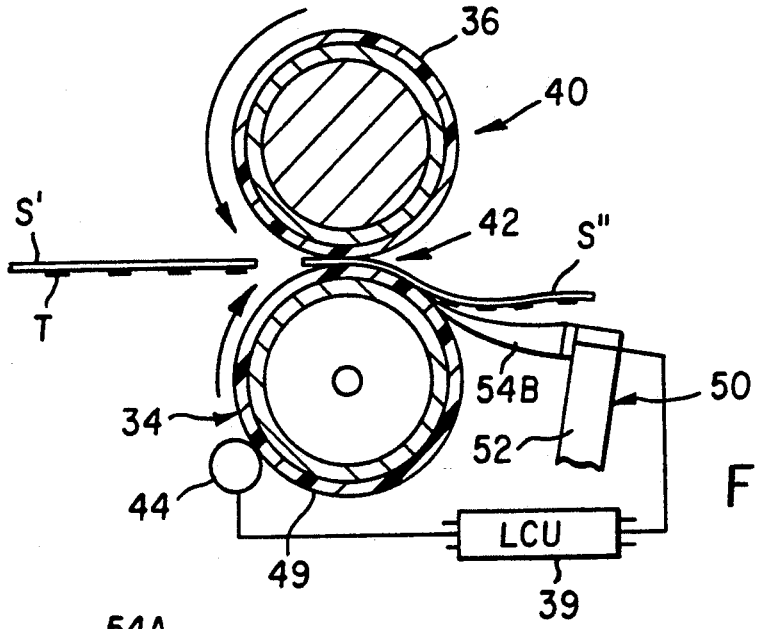
FIG. 2 is a cross-section of the fusing apparatus of the reproduction apparatus of FIG. 1 including the skive device of the present invention.
Figure 3A:
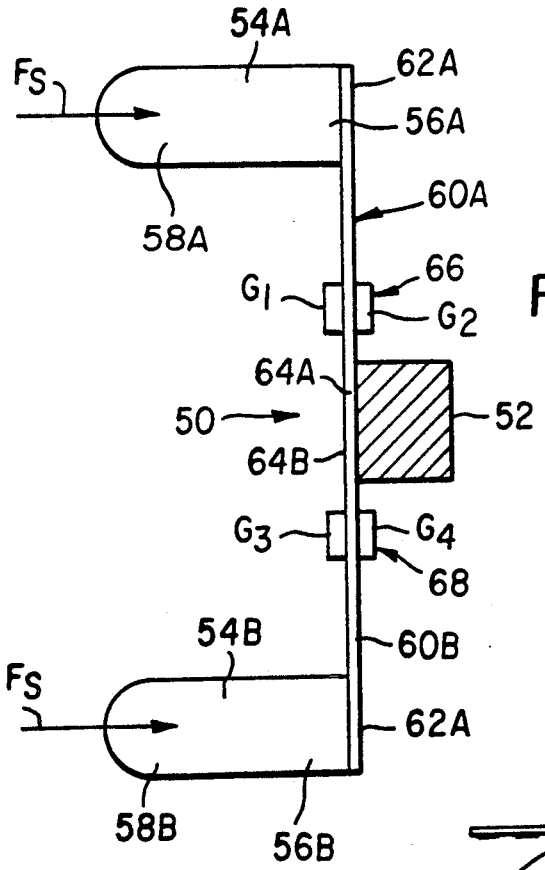
FIG. 3A is a top view of the skive device of the present invention.
Figure 3B:
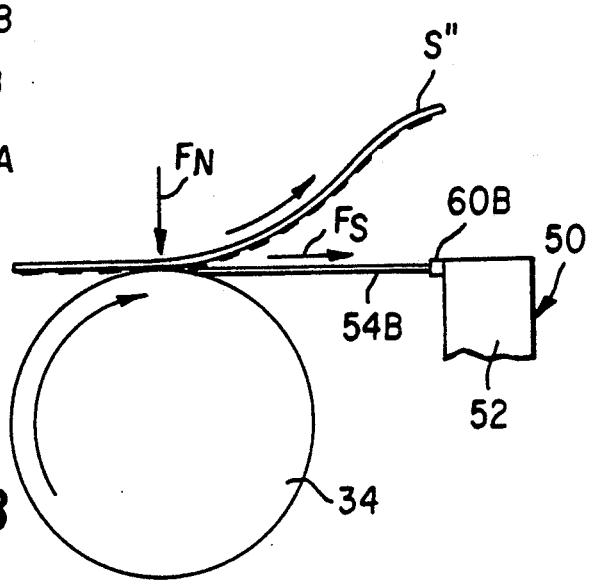
FIG. 3B is an end view of the fuser roller of the fusing apparatus illustrating the copy sheet stripping force of the present invention.

Referring now to FIGS. 2-3B, the fusing apparatus 40 and skive device 50 of the present invention are shown. The fusing apparatus 40 includes the rotatable pressure roller 36, and the rotatable fuser roller 34 which forms the fusing nip 42 with the pressure roller 36. The fuser roller 34 is heated for example by an internal lamp 48, and the oiling member 44 which is connected to, and controlled by, the LCU 39, applies toner release oil at a predetermined and variable desired rate to the surface 49 of the fuser roller 34. A copy sheet S' carrying an unfused toner image T is moved into the fusing nip 42 and is contactably moved through the nip 42 such that the toner image T directly contacts the heated surface 49 of the fuser roller 34.

As a fused copy sheet shown as S" exits the nip 42, it is stripped from the surface 49 of the heated fuser roller 34 by the skive device 50 of the present invention. As shown, the skive device 50 includes a rigid support portion 52, and first and second finger portions 54A and 54B, respectively. Each finger portion 54A, 54B has a first end 56A, 56B, respectively, and a second end 58A, 58B, that contactably rides on the surface 49 of the fuser roller 34 for stripping the fused copy sheet S". Each such second end 58A, 58B of the finger portions 54A, 54B respectively, is positioned to ride on the surface 49 and to experience an actual copy sheet stripping force $F_S$ when stripping a fused copy sheet S" from the surface 49.

The skive device 50 includes first and second elongate flexible members 60A, 60B, respectively. As shown, a first end 62A, 62B, respectively, of each of the flexible members 60A, 60B is connected respectively to the first and second finger portions 54A, 54B for receiving and transmitting actual copy sheet stripping forces experienced by the finger portions. A second end 64A, 64B respectively of each of the flexible members 60A, 60B is connected to the rigid support portion 52. Each flexible member 60A, 60B, for example is a thin, flat and narrow metallic strip that has first and second surfaces. Each is connected flatly onto the rigid support portion 52 such that the first surface thereof faces the fuser roller 34. As such, each flexible member can be made from a thin stainless steel strip of about 16 mils thick. The compliance of each flexible member 60A, 60B in the horizontal plane of the finger portions 54A, 54B should be approximately 0.3 in/lb.

The skive device 50 further includes first and second force measurement devices shown generally as 66 and 68, respectively, for measuring the actual copy sheet stripping force $F_S$ which is being transmitted by the first and second flexible members 60A, 60B. Each force measurement device 66, 68 includes means for connecting it to the logic and control unit 39. In addition, each of the force measurement devices is preferably a strain gauge assembly that includes a first strain gauge $G_1$, $G_3$ respectively, bonded on the first surface of each of the flexible members, and a second strain gauge $G_2$, $G_4$ respectively, bonded oppositely to the first strain gauge, on the second surface of each flexible member. Each of the strain gauges $G_1$-$G_3$, for example, can be a common foil bonded to a Kapton (trademark of DuPont of Delaware) resistance gauge.

The strain gauges $G_1$, $G_2$, $G_3$ and $G_4$ are bonded to the first surface of the flexible members 60A, 60B using an adhesive, for example, a solvent free cyanoacrylate based cement. Each assembly 66, 68 of strain gauges $G_1$, $G_2$, $G_3$, $G_4$ as shown should be bonded as close as possible to the second end 64A, 64B of the flexible members 60A, 60B so as to maximize the sensitivity of the gauges to the sheet stripping force $F_S$ being experienced by the finger portions 54A, 54B.

Referring to FIG. 3B, the sheet stripping force $F_S$ can be viewed as the product of a normal force $F_N$ that acts on each finger portion 54A, 54B, and of the coefficients of friction $U_1$ and $U_2$ between each finger portion and the fuser roller ($U_1$) and between each finger portion the fused copy sheet S" ($U_2$), respectively. The force $F_N$ is produced by the adhesion of the fused toner image and of the copy sheet S" itself to the surface 49 of the fuser roller. Together with the rotational effect of the surface 49, the force $F_N$ as factored by the coefficients of friction $U_1$, $U_2$, result in the frictional thrust force $F_S$ which acts to deflect the second end 58A, 58B of each finger portion 54A, 54B into the flexible member 60A, 60B. The strain gauge assembly 66, 68 on each flexible member measures the deflection of the flexible member under the force $F_S$, which is, of course, related to the normal force $F_N$.

Figure 4A:
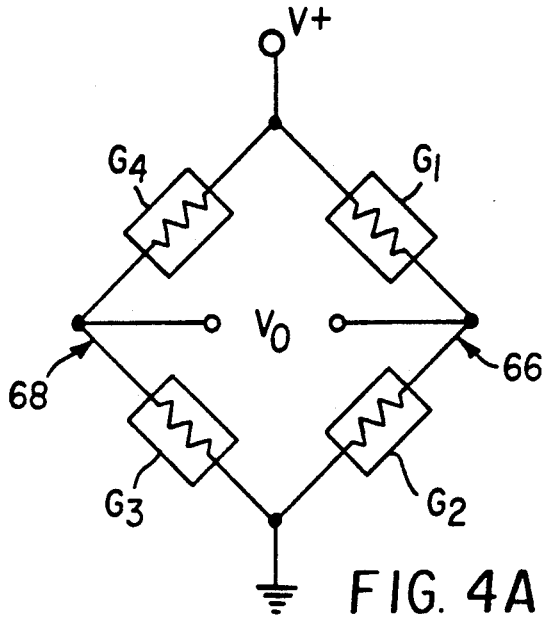
FIGS. 4A and 4B are first and second embodiments of the force measurement device of the present invention.
Figure 4B:
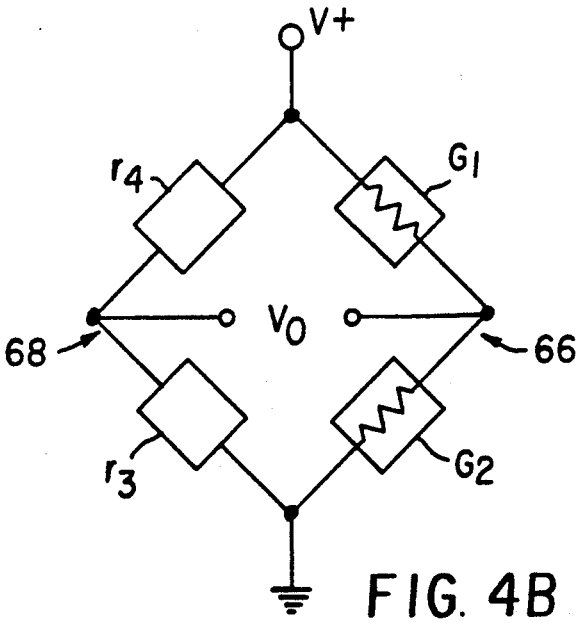

Referring to FIG. 4A, the strain gauge assemblies 66, 68 are connected electrically so as to each represent two legs of a wheatstone bridge circuit that has a strain gauge $G_1$, $G_2$ and $G_3$, $G_4$ on each of the two legs respectively. As shown, the strain gauges $G_1$–$G_4$ of the two assemblies 66, 68 represent a full wheatstone bridge. A common gauge resistance of 120 ohms for each strain gauge is preferred, however, a wheatstone bridge circuit with other resistance values for the strain gauges are equally effective as long as all the nominal resistances of the bridge are the same. An alternative embodiment of the strain gauge wheatstone bridge of FIG. 4A is shown in FIG. 4B where one of the strain gauge assemblies, for example, the second assembly 68, is replaced by common circuit resistors $r_3$, $r_4$ which have nominal values equal to the nominal gauge resistances of replaced strain gauges $G_3$, $G_4$.

For the process control purposes of the present invention, the logic and control unit (LCU) 39 is preprogrammed with a desired or ideal standard value for an expected sheet stripping force $F_S$ under ideal toner laydown density, and under an ideal toner release oil application rate. In operation, several readings of the actual sheet force $F_S$ are made and fed to the LCU 39 for statistical analysis and comparison to the preprogrammed standard value. Deviations (if any) of varying magnitude can be programmed to represent various states or conditions of toner laydown density and of release oil application rate. Accordingly, corrective adjustments, for example, can include increasing or decreasing the potential level of the layer of charge in order to effect an increase or decrease in toner laydown density, as well as to include increasing or decreasing the release oil application rate. Additionally, a process and control response to such a statistical analysis and comparison of actual vs. standard sheet stripping forces may be to initiate an automatic service call.

The invention has been described in detail with particular reference to preferred embodiments thereof, but it will be understood that variations and modifications can be effected within the spirit and scope of the invention.

What is claimed is:

1. A skive device for stripping copy sheets from the surface of a fusing roller of a reproduction apparatus, the skive device comprising:

(a) a rigid support portion;

(b) a finger portion having a first end, and a second end for contactably riding on the surface of the fusing roller in order to experience an actual copy sheet stripping force when stripping a copy sheet therefrom;

(c) an elongate flexible member connected at one end thereof to said first end of said finger portion and at the other end thereof to said rigid support portion for receiving and transmitting an actual copy sheet stripping force experienced by said finger portion; and (d) a force measurement device mounted to said flexible member for measuring an actual copy sheet stripping force being received from said finger portion by said flexible member, whereby the measured force can be used to control processes of the reproduction apparatus.

2. The skive device of claim 1 including a plurality of said finger portions each being connected by a flexible member to a rigid support portion.

3. The skive device of claim 2 wherein each said flexible member includes a force measurement device mounted thereon.

4. The skive device of claim 3 wherein each of said flexible members is a thin metallic strip having first and second surfaces, the first surface facing the fuser roller.

5. The skive device of claim 3 wherein each of said force measurement devices includes means for connecting to a logic and control unit.

6. The skive device of claim 5 wherein each of said force measurement devices is a strain gauge assembly.

7. The skive device of claim 6 wherein each said strain gauge is a foil bonded to a resistance gauge.

8. The skive device of claim 7 wherein said strain gauge assembly includes first and second strain gauges bonded on said first and second surfaces respectively of said flexible member.

9. The skive device of claim 8 wherein each said strain gauge is bonded as close as possible to said other end of said flexible member so as to maximize sensitivity of said strain gauge assembly to an actual sheet stripping force being transmitted by said flexible member.

10. The skive device of claim 9 wherein said strain gauge assembly of each force measurement device forms two legs of a wheatstone bridge with a strain gauge on each of said two legs.

11. The skive device of claim 10 wherein first and second strain gauge assemblies on first and second flexible members form a full wheatstone bridge having a strain gauge on each leg of said wheatstone bridge.

12. A fusing apparatus for fusing toner images on copy sheets in a reproduction apparatus including process stations and a logic and control unit, the fusing apparatus comprising:

(a) a rotatable pressure roller;

(b) a rotatable fuser roller forming a fusing nip with said pressure roller for moving a copy sheet therethrough such that the toner images on the copy sheet contact the fuser roller;

(c) a skive device for stripping the copy sheet from the fuser roller, the skive device including:

(i) a rigid support portion;

(ii) first and second finger portions each having a first end, and a second end contactably riding on the surface of the fuser roller for stripping a copy sheet therefrom, each said second end experiencing a sheet stripping force when stripping a copy sheet;

(iii) first and second elongate flexible members each having a first end and a second end, said first ends of said first and second flexible members being connected to said first and second finger portions, respectively, for receiving and transmitting actual sheet stripping forces experienced by said finger portions, and said second ends of said first and second flexible members being connected to said rigid support portion; and (iv) first and second force measurement devices connected to said first and second flexible members, respectively, for measuring actual sheet stripping forces being transmitted by said first and second flexible members, respectively.

13. The fusing apparatus of claim 12 including an oiling member for applying toner release oil to the surface of said fuser roller.

14. The fusing apparatus of claim 13 wherein said oiling member and said force measurement device each include means for connecting to the logic and control unit of a reproduction apparatus.

15. A reproduction apparatus comprising:

(a) a movable imaging member;

(b) a charging process station including charging means for laying down on said imaging member a layer of electrostatic charges having a desired potential level;

(c) means for imagewise dissipating portions of said layer of charges to form a latent image;

(d) a development station for laying down toner particles on said latent image to form a toner image, said toner particle laydown having a density varying as said desired potential level of said layer of charges on said imaging member;

(e) means for transferring the toner image to a receiver sheet;

(f) a fusing process station including a heated rotatable fuser roller, an oiling member for applying toner release oil at a desired rate to the surface of the fuser roller, and a rotatable pressure roller forming a fusing nip with said fuser roller; and (g) process control means associated with said fuser roller for controlling said charging means to increase and reduce said desired potential level of said layer of charges on said imaging member, and for controlling said oiling member to increase or reduce said rate of release oil application to said fuser roller, said control means including:

(i) a logic and control unit; and (ii) a skive device including a finger portion for stripping receiver sheets from the surface of said fuser roller, said finger portion experiencing a sheet stripping force when stripping a sheet from said surface of said fuser roller, said sheet stripping force varying as a function of the density of toner laydown on a sheet being stripped, as well as, a function of the rate of release oil applied to said fuser roller, said finger portion including a force measurement device for measuring a sheet stripping force experienced by said finger portion, said force measurement device being connected to said logic and control unit, said logic and control unit including a preprogrammed desired standard value for a sheet stripping force for said finger portion on said fuser roller, and said control means controlling said charging means and said oiling member responsively to deviations of experienced stripping forces from said desired standard value.

16. The reproduction apparatus of claim 15 wherein said finger portion is connected to a first end of an elongate flexible member for transmitting said experienced stripping force to said flexible member.

17. The reproduction apparatus of claim 16 wherein a second end of said flexible member is connected to a rigid support member.

18. The reproduction apparatus of claim 17 wherein said force measurement device is bonded to said flexible member close to said second end thereof.

19. The reproduction apparatus of claim 18 wherein said force measurement device is a strain gauge assembly.

* * * * *